US005165454A

United States Patent [19]

Kanayama et al.

[11] Patent Number: 5,165,454

[45] Date of Patent: Nov. 24, 1992

[54] DETECTION OF WARP IN REED DENT BEFORE LOOM START UP

[75] Inventors: Hiroyuki Kanayama, Kariya; Yoshikatsu Kisanuki, Seto; Kazunori Yoshida, Nagoya, all of Japan

[73] Assignees: Kabushiki Kaisha Toyoda Jidoshokki Seisakusho, Kariya; Kabushiki Kaisha Toyota Chuo Kenkyusho, Aichi, both of Japan

[21] Appl. No.: 614,721

[22] Filed: Nov. 15, 1990

[30] Foreign Application Priority Data

Nov. 20, 1989 [JP] Japan ..... 1-301677

[51] Int. Cl.[5] ..... D03J 1/14

[52] U.S. Cl. ..... 139/353; 139/351; 139/66 R; 364/921.1

[58] Field of Search ..... 139/35, 353, 351, 368, 139/66 R; 364/470, 921.1; 28/209, 211, 187; 66/1 R, 163

[56] References Cited

U.S. PATENT DOCUMENTS

| | | | |
|---|---|---|---|
| 4,817,675 | 4/1989 | Dewaele et al. | 28/209 X |
| 4,898,213 | 2/1990 | Takegawa | 139/353 X |
| 4,911,207 | 3/1990 | Gryson et al. | 139/353 |
| 5,046,535 | 9/1991 | Prat | 139/353 |

FOREIGN PATENT DOCUMENTS

| | | |
|---|---|---|
| 63-85142 | 4/1988 | Japan . |
| 64-14347 | 1/1989 | Japan . |

*Primary Examiner*—Andrew M. Falik
*Attorney, Agent, or Firm*—Brooks Haidt Haffner & Delahunty

[57] ABSTRACT

A warp insertion monitoring method and apparatus for positively protecting woven cloth from defects due to warp insertion error or failure. A warp detector is disposed on a loom so as to have a warp presence/absence detection region located at a front or rear side and in the vicinity of a reed which serves for beating a weft inserted through a shedding formed by the upward/downward motion of healed frames against a cloth fell. The presence or absence of abnormalities in respect to the positions at which warps are inserted through the reed is identified on the basis of detection information available from the output of the warp detector. Detection timing for the warp detection information is so established as to fall within a period during which the loom is stopped, so that the presence or absence of errors in respect to the warp insertion can be detected before the loom is restarted.

19 Claims, 7 Drawing Sheets

DETECTION OF WARP IN REED DENT BEFORE LOOM START UP

BACKGROUND OF THE INVENTION

1. Field of the Invention

The present invention relates to an apparatus and a method for detecting occurence of an abnormality in the warp positions with respect to a reed in a weaving machine or loom.

2. Description of the Related Art

Conventionally, woven cloth or finished fabric is subjected to an inspection process for checking the presence or absence of defects in the woven cloth. In this conjunction, it is however noted that such defect checking in the inspection process provides no effective means for remedying such a defect, which is brought about by an error or failure in inserting or drawing a warp through an inter-dent gap of a reed after breakage of a warp. As such a defect continuously makes appearance on the fabric in the warpwise direction, it should be detected as soon as possible, before it results in a serious problem of producing a defective fabric product. According to a technique disclosed in JP-A-60-231850 (Japanese Patent Application No. 231850/60) and JP-A-63-85142, an inspecting apparatus is mounted on a loom for performing a field inspection for a woven cloth. However, this inspection is also unsatisfactory for eliminating a defect which is due to an error or failure in the warp insertion between the dents of a reed, because the inspection is done on the finished fabric.

In the apparatus disclosed in JP-A-64-14347, swingable pieces are interposed, respectively, between adjacent dents of a reed at a top portion thereof. When neither error nor failure occurs in the insertion of a warp, the associated swingable piece is caused to move out of a light beam path of a light-transmission type photoelectric sensor by the warp moved to the uppermost position thereof at a rotational angle of the loom where the warps are moved topmost. However, if some warp is not present at the inter-dent gap at the topmost position because of the occurrence of a warp breakage or slack, the swingable piece is not moved upwardly and remains at a position where the light beam path is thereby intercepted. With such an arrangement, the presence or absence of the warp between the dents of the reed can be detected with certainty.

However, the function of the apparatus disclosed in JP-A-64-14347 is to detect breakage of the warp, wherein the detection of the presence or absence of the intersection between the swingable piece and the light beam path must necessarily be performed during operation of the loom. Consequently, detection of error or failure in the insertion of the warps through the reed is performed only after the loom is restarted, which in turn means that the loom is stopped when a warp insertion error or failure is detected and then restarted, which unavoidably results in that defect of more or less severity makes its appearance on the woven cloth.

SUMMARY OF THE INVENTION

Accordingly, a primary object of the present invention is to provide a warp insertion detecting or monitoring method and apparatus capable of positively preventing defects, due to failure or error in the warp insertion, from appearing on woven cloth or fabric.

In view of the above and other objects, which will be more apparent as description proceeds, the invention relates to a weaving machine, in which a weft inserted through a shedding formed by upward and downward motions of heald frames is beaten by a reed against a cloth fell of cloth being woven. According to an aspect of the invention, a warp detector having a region in which the presence/absence of warps are to be detected is provided in the vicinity of the reed for detecting the presence or absence of abnormality in the positions, at which the warps are inserted through the reed, on the basis of detection information obtained by the warp detector. The timing for acquiring the warp detection information is so set as to fall within a period of time during which the weaving machine is stopped.

According to the teachings of the present invention, the warp detection is performed for every inter-dent gap of the reed at the front or rear side thereof at positions closely located to the reed, whereby error or failure (hereinafter generally referred to as failure) in the warp insertion through the inter-dent gaps can be identified on the basis of the detection information. The warp detection by the warp detector is performed at a time point when the loom is stopped, whereby the presence or absence of the warp insertion failure can be detected before the loom is restarted.

DESCRIPTION OF THE PREFERRED EMBODIMENTS

Now, the present invention will be described in detail by reference to FIGS. 1 to 4 in conjunction with a first exemplary embodiment thereof.

Figure 1:
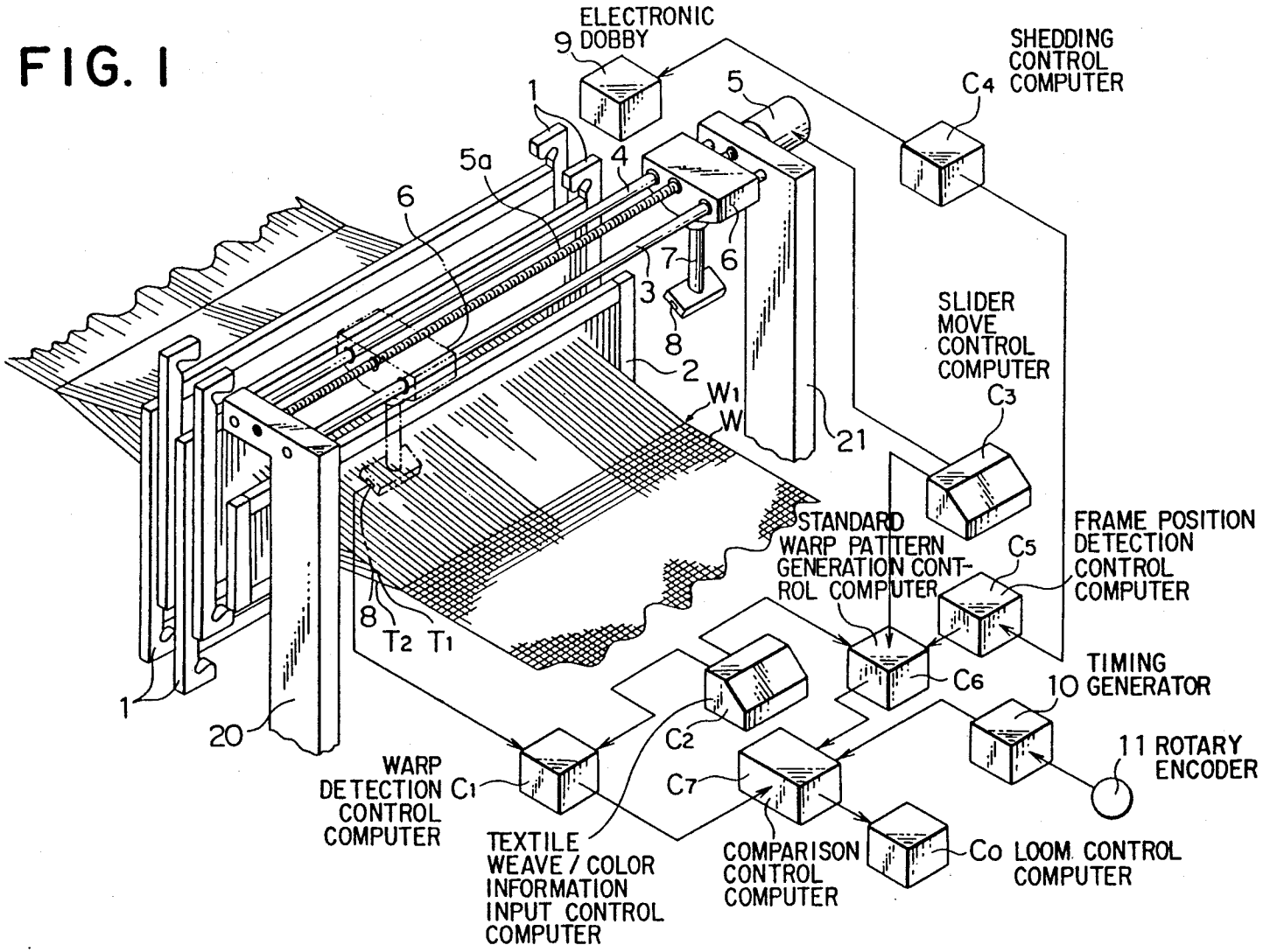
FIG. 1 is a perspective view showing a major portion of a loom incorporating a warp insertion detecting or monitoring apparatus according to an embodiment of the present invention together with electronic components of the apparatus which are schematically shown in a block diagram.
Figure 2:
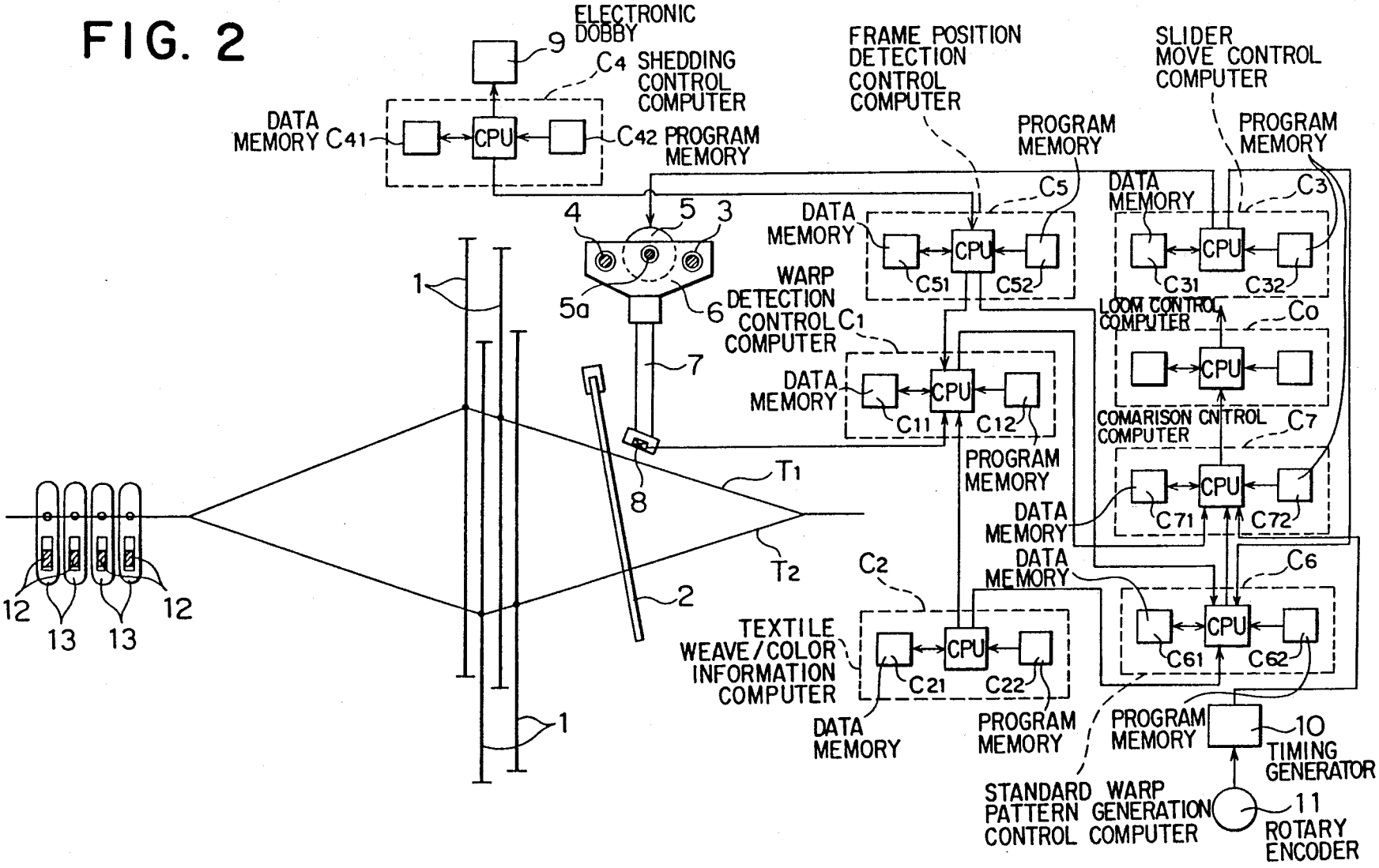
FIG. 2 is a schematic side view of the same together with the electronic components thereof shown in blocks.
Figure 3:
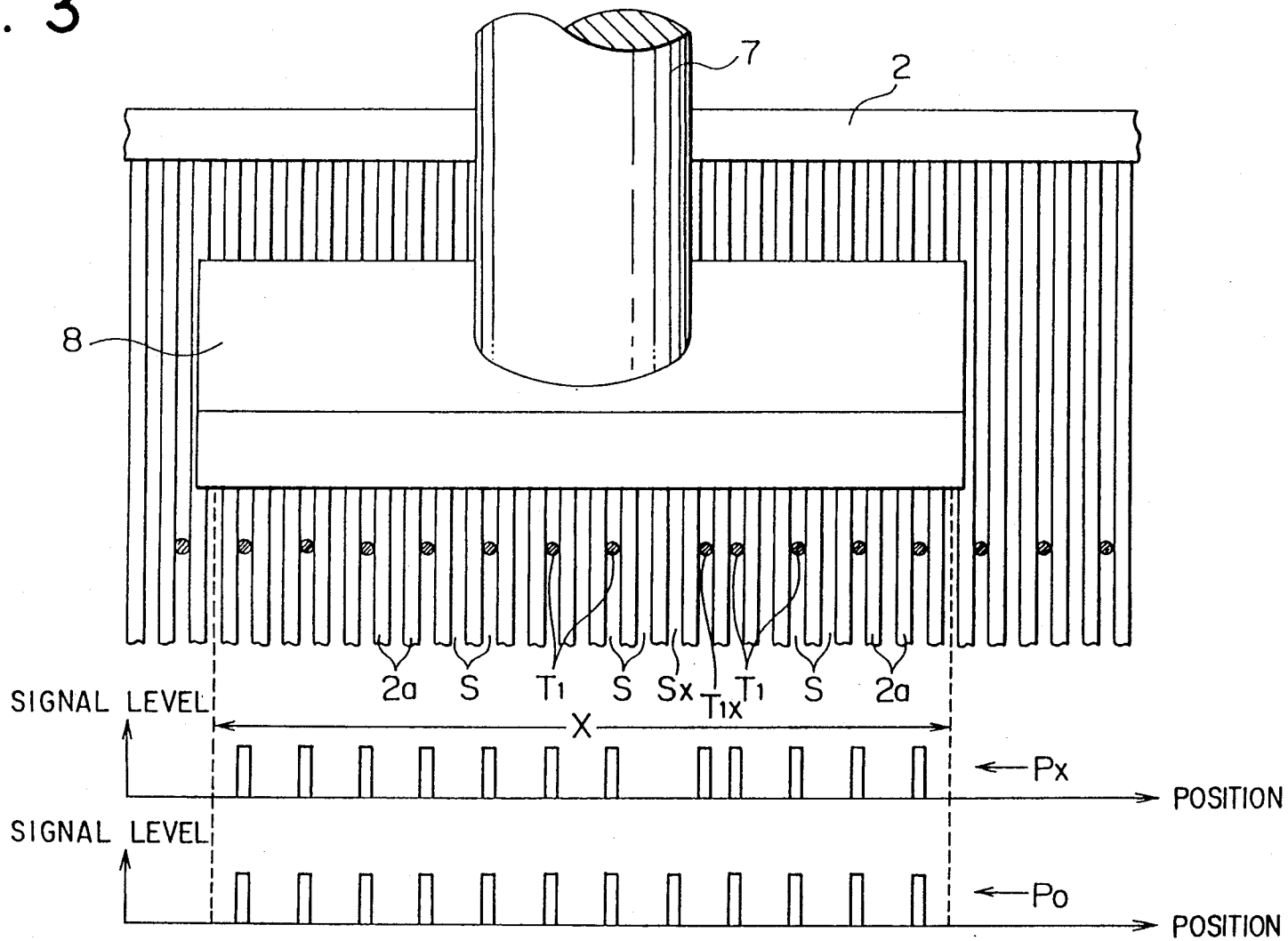
FIG. 3 is a view showing a major portion of the warp insertion detecting or monitoring apparatus according to the invention together with signal waveform diagrams for illustrating operation of the same.

Referring to FIGS. 1 to 4, warps $T_1$ and $T_2$ which cooperate to form a shedding therebetween every time a plurality of heald frames 1 are moved vertically in opposition to each other are inserted through inter-dent gaps S, $S_x$ defined between adjacent dents 2*a* of a reed 2. All the warps $T_1$ in a region shown in FIG. 3 are at the uppermost position.

Disposed above the warps $T_1$ and $T_2$ and between a cloth fell $W_1$ of cloth W being woven and the heald frames 1 are a pair of guide rails 3 and 4 which are supported by upstanding support columns 20 and 21 so as to extend in parallel with each other along the widthwise direction of the cloth being woven. A threaded shaft 5a is disposed between the guide rails 3 and 4 in parallel thereto and has one end rotatably supported by the supporting column 20. The other end portion of the threaded shaft 5a extends through and beyond the supporting column 21 to be operatively coupled to a reversible electric motor 5. Supported on both guide rails 3 and 4 is a slider 6 through which the threaded shaft 5a threadably extends so that the slider 6 can be moved to the left or right, as viewed in FIG. 1, on and along the guide rails 3 and 4 on the basis of the direction in which the electric motor 5 is rotated. It should be noted that the supporting columns 20 and 21 are disposed at such positions that both ends of the guide rails 3 and 4 and the threaded shaft 5a project laterally beyond the corresponding ends of the reed 2, respectively. Usually, the slider 6 is retracted to the position shown by solid lines in FIG. 1 so as not to interfere with the beating motion of the reed 2.

A suspending rod 7 is fixedly supported by the slider 6 with a warp detector 8 secured thereto at the bottom end. The warp detector 8 may be constituted by a photoelectric image sensor of the reflection type which is well known in the art and is adapted to scan a linear detection region extending over a predetermined distance in the direction widthwise of the cloth being woven. As can be seen in FIG. 2, the path along which the warp detector 8 moves extends in front of the reed 2 in the vicinity thereof with respect to the warp feed direction when the warp detector 8 assumes the most retracted position, while when viewed in the vertical direction, the above-mentioned path is located immediately above the uppermost position of the corresponding portions of the warps $T_1$. The function of the warp detector 8 is to detect the warps that are located at the uppermost position within a region which covers the portions of the warps $T_1$ and $T_2$ that are disposed in front of the reed 2 closely thereto.

A warp detection control computer $C_1$ is electrically connected to the warp detector 8 so that warp detection signal output from the warp detector 8 is inputted to the warp detection control computer $C_1$, which in turn is connected to a textile weave/color information input control computer $C_2$ incorporating a data memory $C_{21}$ in which there are stored previously textile weave information of the cloth W to be woven, color information for the warps $T_1$ and $T_2$ and dent density information (i.e. number of dents per unit length). The textile weave/color information input computer $C_2$ controls transmission of the textile weave/color information and the dent density information in accordance with a work or weaving program stored in a program memory $C_{22}$, while the control computer $C_1$ fetches the color information in a data memory $C_{11}$ for effectuating the warp detection and correction on the basis of a work program stored in a program memory $C_{12}$.

The electric motor 5 for moving or driving the warp detector 8 in the direction widthwise of the cloth being woven is connected to a slider move control computer $C_3$ so that the warp detector 8 is moved under the control of the computer $C_3$. More specifically, the slider move control computer $C_3$ is adapted to perform a feedback control for rotating and stopping the motor 5 on the basis of the positional information for detection loaded in a data memory $C_{31}$ and a work program stored in a program memory $C_{32}$. In other words, the slider move control computer $C_3$ receives a rotational or angular position signal detected by a rotary encoder (not shown, but well known in the art) which is incorporated in the motor 5, thereby performing the control such that the position at which the slider 6 is stopped, determined on the basis of the detected angular position signal as above mentioned, coincides with the desired position.

Upward and downward motions of the plural heald frames 1 are effected with the aid of an electronic Dobby apparatus 9 in a manner well known in the art, wherein the Dobby apparatus 9 is subjected to the control of a shedding control computer $C_4$. More specifically, the shedding control computer $C_4$ controls the electronic Dobby apparatus 9 on the basis of textile weave information of the cloth W to be woven which has previously been loaded in a data memory $C_{41}$ and a work program stored in a program memory $C_{42}$ while controlling the transfer or transmission of the textile weave information and the frame position information.

Connected to the shedding control computer $C_4$ is a frame position detection control computer $C_5$ which receives the textile weave information and the frame position information from the shedding control computer $C_4$, wherein the received information is stored in a data memory $C_{51}$. The frame position detection control computer $C_5$ is adapted to execute a control for transmission or transfer of the textile weave information and the frame position information in accordance with a work program stored in a program memory $C_{52}$. Further, the warp detection control computer $C_1$ is connected to the frame position detection control computer $C_5$ so that the frame position information can be sent to the warp detection control computer $C_1$.

A standard warp pattern generation control computer $C_6$ is connected to the textile weave/color information input control computer $C_2$, the slider (warp detector) move control computer $C_3$ and the frame position detection control computer $C_5$ in such a manner as shown in FIG. 2. The standard warp pattern generation control computer $C_6$ receives the textile weave information and the dent density information from the textile weave/color information input control computer $C_2$, the designated detection position information from the slider move control computer $C_3$ and the frame position information from the frame position detection control computer $C_5$, respectively, the received information mentioned above being stored in an associated data memory $C_{61}$ (FIG. 2). Thus, the standard warp pattern generation control computer $C_6$ serves to generate a group of standard warp array patterns on the basis of the various information received in accordance with a work program stored in an associated program memory $C_{62}$ and control the transfer or transmission of the standard warp array patterns.

A comparison control computer $C_7$ is connected to the standard warp pattern generation control computer $C_6$ and the warp detection control computer $C_1$. The comparison control computer $C_7$ receives a group of the standard warp array patterns from the standard warp pattern generation control computer $C_6$ and the warp detection information from the warp detection control computer $C_1$, respectively, which items of information are stored in a data memory $C_{71}$ incorporated in the comparison control computer $C_7$. The function of the comparison control computer $C_7$ is to compare one of the standard (reference) warp array patterns with the warp detection information in response to a timing signal inputted from a timing generator 10.

The timing generator 10 is so implemented as to shape the waveform of an angular signal outputted from the rotary encoder 11 for detecting the rotational angle of the loom once per loom revolution, to thereby generate a timing signal which is then outputted to the comparison control computer $C_7$.

As will be apparent from the foregoing description, it can be said that the warp insertion detecting or supervising system according to the illustrated embodiment of the present invention comprises: frame position detecting means for detecting upper/lower positions of the heald frames upon forming of the shedding for the weft; textile weave information input means for inputting textile weave information of a cloth being woven; standard or reference warp pattern generating means for generating standard or reference warp array information on the basis of the textile weave information available from the textile weave information input means and the frame position detection information supplied from the frame position detecting means; warp detector moving means for moving and positioning the warp detector having the warp presence/absence detection region in front of the reed closely thereto at a specific or particular region extending in the direction widthwise of the cloth being woven; comparison/decision means for making a decision as to the presence or absence of an abnormality in the inserted warp position in the reed on the basis of the result of comparison between, the information regarding the actual warp array pattern within the abovementioned specific region as supplied by the warp detector, and the standard warp array pattern information supplied from the standard warp array pattern generating means; and timing signal generating means for generating a comparison timing signal supplied to the comparison/decision means.

As is well known in the art, each of the warps $T_1$, $T_2$ is inserted through a respective dropper 13, in which contact bars 12 are inserted, respectively, wherein upon occurrence of breakage of a warp $T_1$, $T_2$, the associated dropper 13 drops on to the contact bar 12 to thereby generate a warp breakage detection signal, which is then input to a loom control computer $C_0$. In response to the warp breakage signal, the loom control computer $C_0$ commands stoppage of operation of the loom. Thereafter, the loom control computer $C_0$ commands the reverse revolution of the loom to cause the reed 2 to be moved to the most retracted position shown in FIG. 2 while forming the shedding.

Figure 4A:
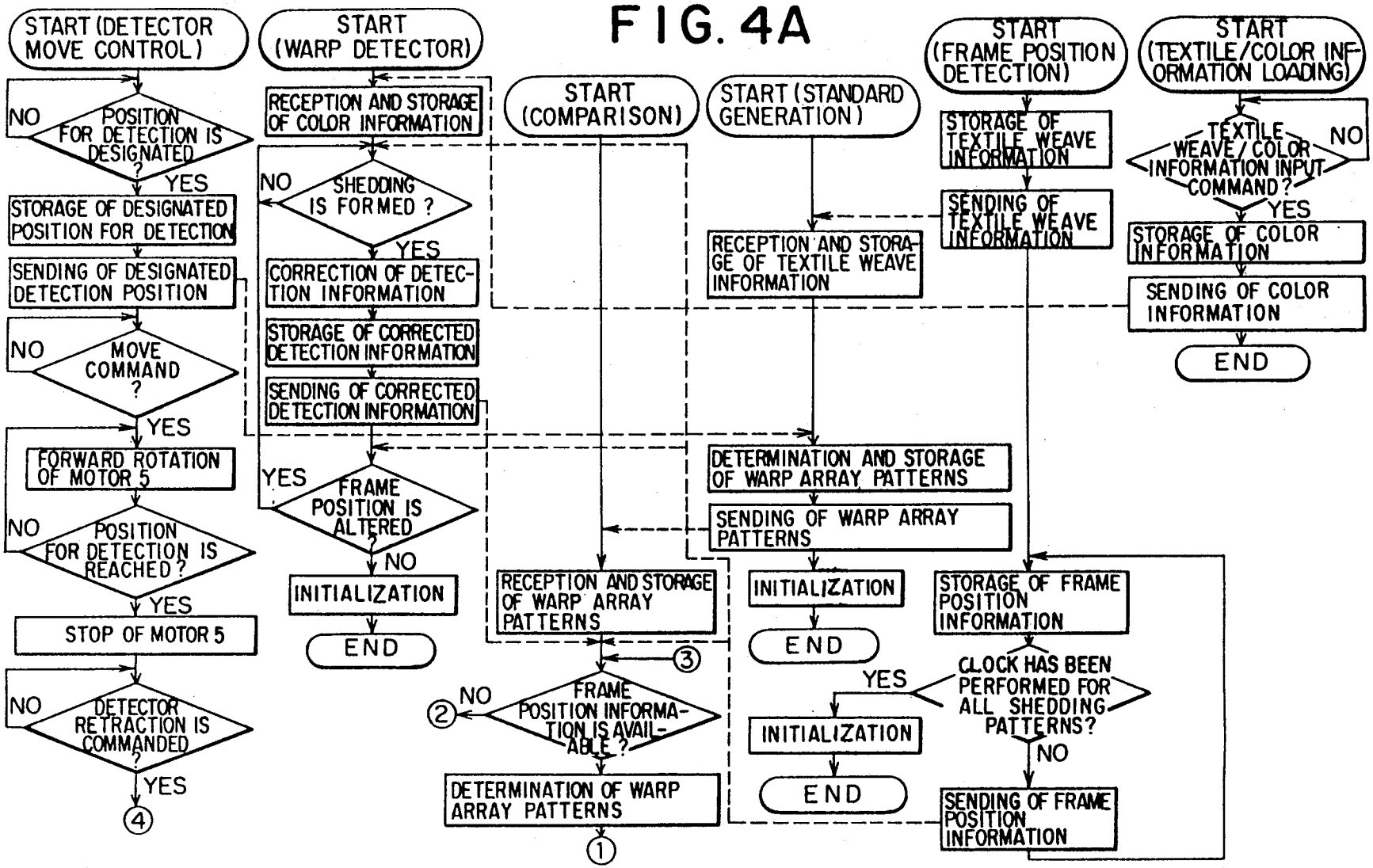
FIGS. 4A and 4B show flow charts for illustrating the processings executed for warp insertion failure detection.
Figure 4B:
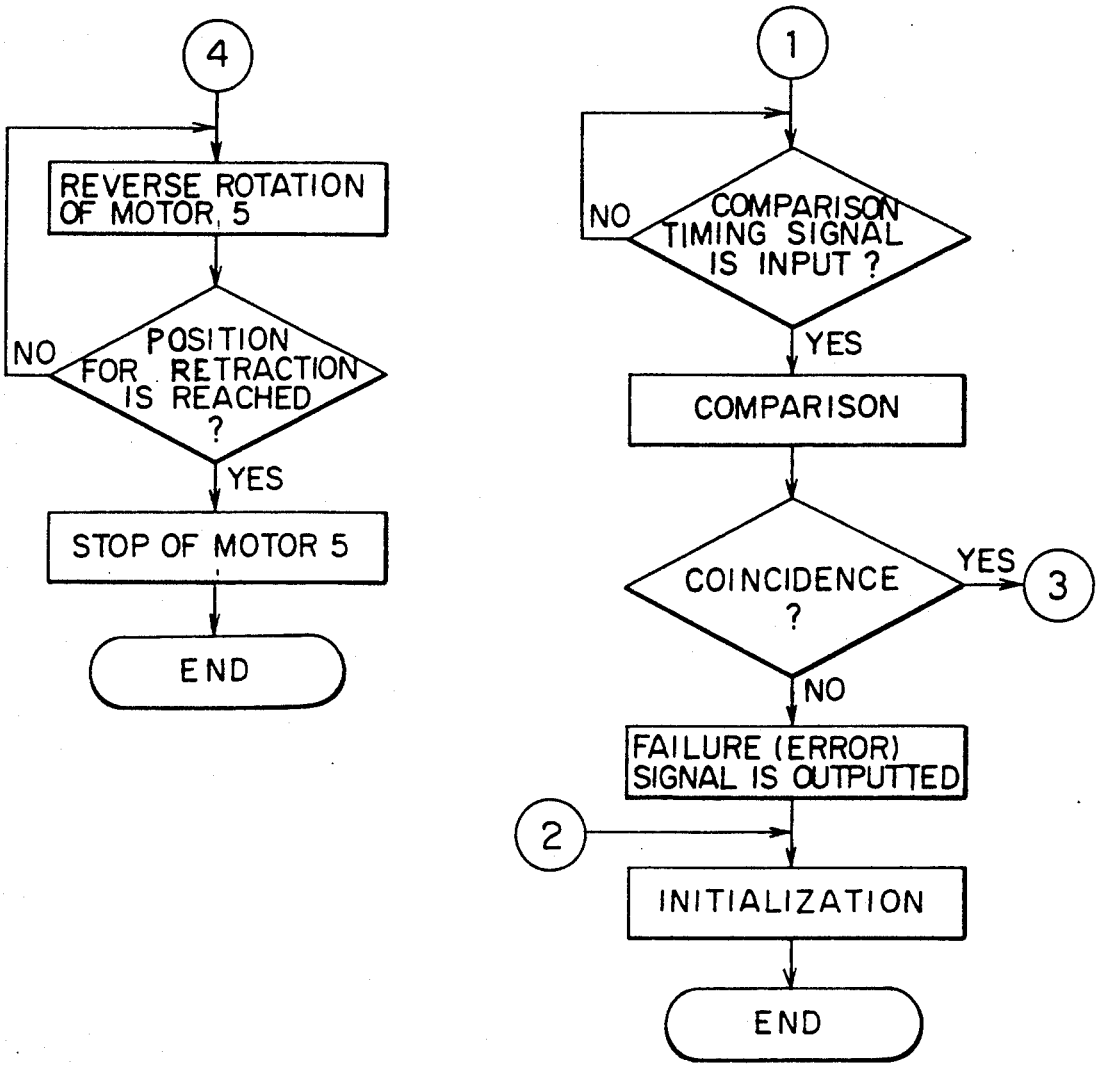

FIGS. 4A and 4B are flow charts illustrating a programmed procedure for detecting failure in the insertion of the warps $T_1$; $T_2$ into and through the reed 2. This warp insertion failure detection program is executed after stoppage of the loom brought about by warp breakage and after the reverse revolution of the loom described above.

It should be recalled that the textile weave information or data for the cloth W being woven has been previously loaded in the shedding control computer $C_4$ destined to control the electronic Dobby apparatus 9, while the color information for the cloth has been previously loaded in the textile weave/color information control computer $C_2$. The frame position detection control computer $C_5$ fetches to store therein the textile weave information from the shedding control computer $C_4$, while the standard warp pattern generation computer $C_6$ fetches to store therein the textile weave information from the frame position detection control computer $C_5$. Further, the warp detection control computer $C_1$ fetches to store therein the color information from the textile weave/color information input control computer $C_2$.

After occurrence of breakage of a warp, operations of a warp feed apparatus (not shown) and a woven cloth wind-up apparatus (not shown) are stopped. In this state, insertion of a warp through the reed 2 and connection thereof to the woven cloth W are performed, whereupon the warp position information of the warp $T_{1x}$ inserted through the reed 2, i.e. the warp position to be detected by the warp detector 8 is inputted to the slider move control computer $C_3$. In the case of the illustrated embodiment, the position of concern lies within a region X (FIG. 3) extending in the direction widthwise of the woven cloth. The slider move control computer $C_3$ stores this position information and at the same time sends it to the standard warp pattern generation control computer $C_6$, which responds thereto by arithmetically determining the group of warp array patterns within the region X on the basis of the detected position information as supplied as well as the reed dent density information and the textile weave information stored previously therein. The warp array pattern group represents all the warp array patterns standardized for all the up/down positions of the heald frames 1, i.e. for every shedding pattern.

In the stationary state of the warp feed apparatus and the cloth wind-up apparatus, the slider move control computer $C_3$ commands the forward rotation of the electric motor 5 on the basis of a manually input signal requesting motor operation. As a result, the slider 6 moves out from the retracted position in the widthwise direction. When the warp detector 8 has arrived at the region X, the slider move control computer $C_3$ commands stopping of the motor 5.

Upon reaching the region X, the warp detector 8 starts the light beam send/receive operation for effectuating the scanning and photoelectric conversion. The warp detection control computer $C_1$ corrects the signal derived from the photoelectric conversion at the time point when the shedding is formed, i.e. the warp detection information on the basis of the color information. The quantities of light reflected from the warps $T_1$ and $T_2$ differ dependent on the colors of these warps. Accordingly, by correcting the warp detection information with the warp color information, there can be made available more accurate warp presence/absence information. The warp detection control computer $C_1$ stores the corrected warp detection information and at the same time supplies it to the comparison control computer $C_7$.

The shedding control computer $C_4$ supplies to the frame position detection control computer $C_5$ the frame position information representing the top/bottom positions of the heald frames 1 in the state in which the shedding has been formed. The frame position detection control computer $C_5$ stores this frame position information and at the same time supplies it to the standard warp pattern generation computer $C_6$, which then determines one warp array pattern from a set of the stored warp array patterns on the basis of the frame position information, and supplies it to the comparison control computer $C_7$. The comparison control computer $C_7$ then compares the determined standard warp array pattern and the detected warp array pattern derived from the warp detection information mentioned above in response to the inputting of the comparison timing signal supplied from the timing generator 10.

When the warp $T_{1x}$ is not inserted in its intrinsic position, i.e. through the gap $S_x$, as illustrated in FIG. 3, the detected warp array pattern generated for the region X is represented by a pulse-like signal train $P_x$ shown in the same figure, wherein each occurrence of the pulse-like signal represents "presence of the warp", while a pulse-like signal train $P_o$ represents the standard warp array pattern for the region X. Comparison is then performed in order to check whether or not coincidence is found between the pulse-like signal trains $P_x$ and $P_o$. Unless the warp $T_{1x}$ is inserted at its intrinsically proper position $S_x$, a discrepancy is found between the pulse-like signal trains $P_x$ and $P_o$. Consequently, the comparison control computer $C_7$ issues an insertion failure signal to the loom control computer $C_0$, which then executes alarm measures in response to the input of this insertion failure signal.

On the other hand, if it is determined that coincidence exists between both the pulse-like signal trains $P_x$ and $P_o$, the comparison control computer $C_7$ outputs a normal signal, i.e. failure absence signal, to the loom control computer $C_0$ which then responds thereto and commands the shedding control computer $C_4$ to cause the driving of the electronic Dobby apparatus 9. The shedding control computer $C_4$ thus drives the electronic Dobby apparatus 9 under the control thereof to form the shedding for the frame positions set in succession to the preceding frame positions. The warp detection control computer $C_1$ now confirms formation of the shedding on the basis of the frame position information supplied from the frame position detection control computer $C_5$. Subsequently, in the current state of the shedding, there are performed the processings for the correction of the warp detection information, determination of the standard warp array pattern and the comparison between the detected warp array pattern and the reference warp array pattern in such a manner as previously described.

In this way, when discrepancy is verified between the detected warp array pattern and the standard warp array pattern, the alarm processing is executed, while formation of the warp shedding is carried out by altering the frame position when coincidence is determined between the detected warp array pattern and the standard warp array pattern. The detection of absence/presence of the warp insertion failure is performed until all the shedding patterns have been checked around.

After checking for all the shedding patterns around, the slider move control computer $C_3$ commands the reverse or backward rotation of the motor 5 in response to a motor actuation command inputted manually. As a consequence, the slider 6 is caused to move toward the retracted position. Upon arrival of the slider 6 at the retracted position, the slider move control computer $C_3$ issues a command for stopping operation of the motor 5. Subsequently, the loom control computer $C_0$ operates to adjust the position of the cloth fell $W_1$ by rotating backwardly the warp feed apparatus and the cloth wind-up apparatus (both of which are not shown) and thereafter commands the restart of the loom.

It will be understood that the warp insertion monitoring apparatus according to the invention may employ such an arrangement, wherein if the warp insertion error is detected during the checking for all the shedding patterns, the alarm alerts the operator to the error so that he can deal with it and upon the completion of the repair thereof, the warp detector 8 automatically moves to the retracted position to allow the restart of the loom. In this case, it will be necessary to load into the program memory $C_{72}$ of the comparison control computer $C_7$ a program under which the warp insertion monitoring apparatus operates in the above-mentioned manner.

In conjunction with the shedding operation performed in the state in which the warp feed apparatus and the cloth wind-up apparatus are stopped, it is noted that the cloth may undesirably be napped with feathers because of friction between the reed and the warps at same locations thereof. In order to avoid such undesirable phenomenon, both the warp feed apparatus and the wind-up apparatus may be operated instead of stopping them, and the operations of these apparatus may be canceled or taken into account at the time point when the position of the cloth fell is adjusted.

In any case, a series of the warp insertion failure presence/absence detection processings described above are performed before the loom is restarted, and the warp detection is done by the warp detector 8 only within the period during which the loom is stopped. Accordingly, any injury or defect is positively prevented from occurring even slightly due to a failure in inserting the warp through the reed 2, which in turn means that reduction in the availability or operational efficiency of the loom due to stoppage of the restarted loom brought about by such warp insertion failure detection can also be avoided.

In the case of the apparatus disclosed in JP-A-64-14347 cited in the preamble, the warp insertion failure presence/absence detection is restricted to the textile weave of plains. Also, it is required that at least adjacent upper and lower warps be inserted, respectively, through one inter-dent gap. Consequently, as long as some of the swingable pieces are not displaced from the light beam path of the optical sensor, a warp insertion failure is seen to have taken place. Under the circumstances, the warps inserted through the inter-dent gaps, respectively, have to be moved up to the upper limit motion position. The only textile weave which can satisfy such a condition is the plains if at least adjacent upper and lower warps are inserted, respectively, through one inter-dent gap. For this reason, the warp insertion failure detecting apparatus known heretofore are not in the position for coping with a variety of textile weaves.

In contrast, in the embodiment of the present invention, the presence or absence of the warp insertion failure is detected by comparing the detected warp array pattern with the standard warp array pattern. Accordingly, substantially all the textile weaves can be subjected to the inventive warp insertion failure presence/absence detection process which is based on the comparison effected for every one of the warps.

Further, because of the warp detection scheme in which color of the warp is taken into account, extremely high detection accuracy can be assured. However, it should be understood that a sufficiently high detection accuracy can also be attained even when no color information is available.

In the embodiment described above, it has been assumed that an electronic Dobby apparatus 9 is employed, wherein the textile weave information is supplied to the standard warp pattern generation control computer $C_6$ from the shedding control computer $C_4$, as a result of which only the color information is inputted to the textile weave/color information input control computer $C_2$. It should however be noted that in case a mechanical Dobby apparatus, cam shedding motion, or crank shedding motion is adopted or in the case of plain weave, twill weave, or satin weave, the textile weave information may be inputted to the textile weave/color information control computer $C_2$.

Figure 5:
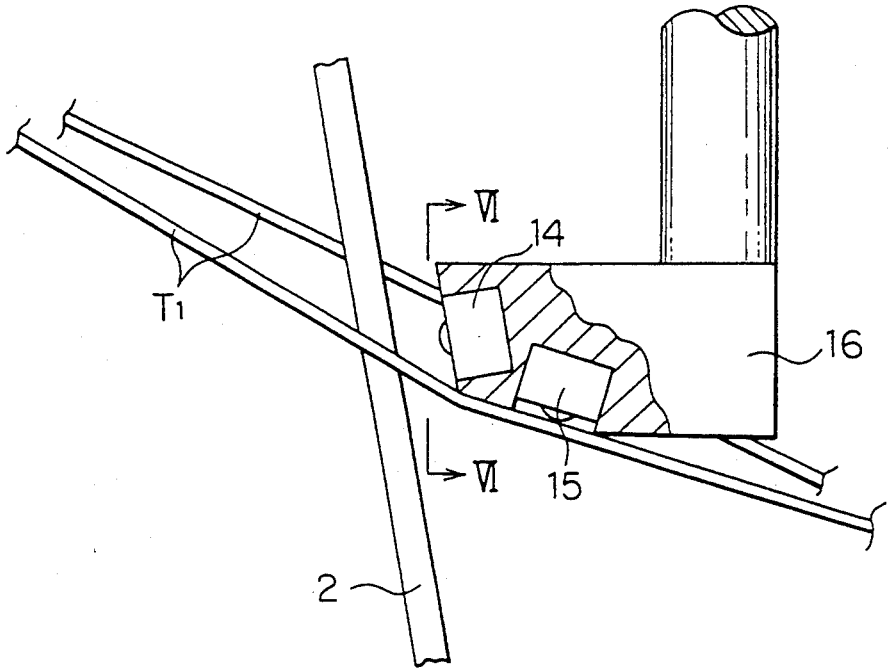
FIG. 5 is a side view showing a major portion of a warp insertion supervising apparatus according to another embodiment of the present invention.
Figure 6:
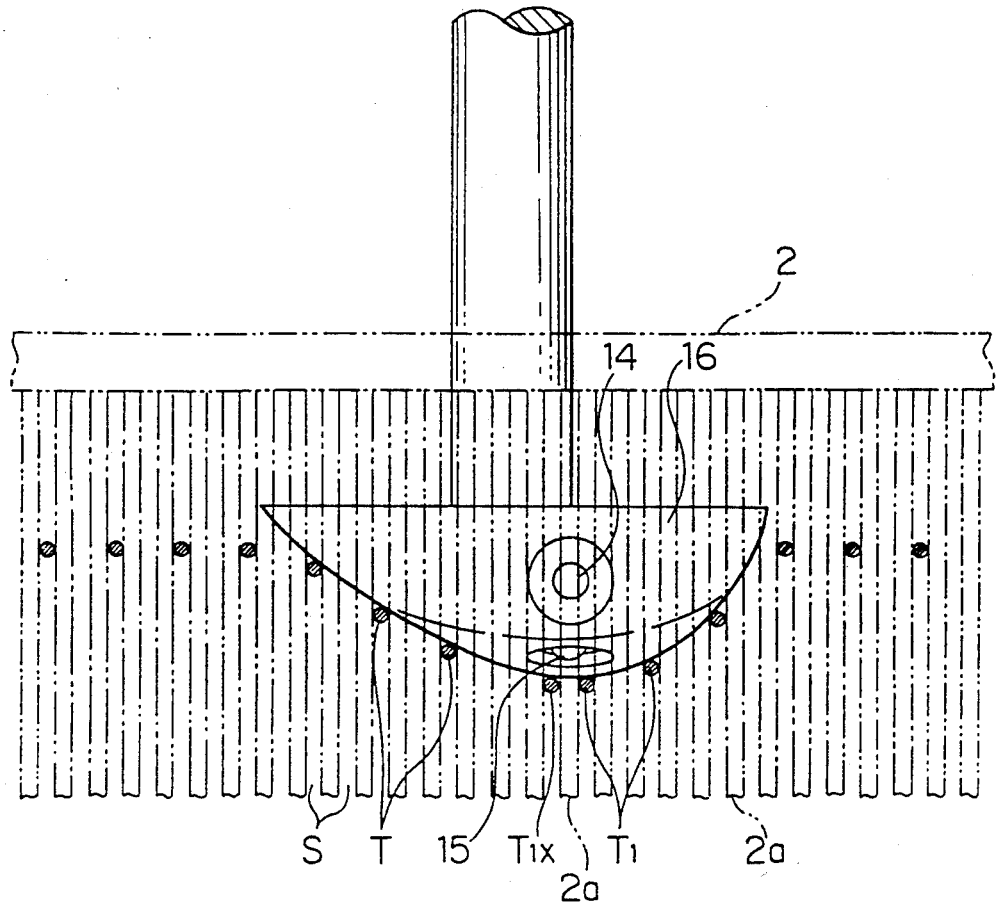
FIG. 6 is a sectional view taken along the line VI—VI of FIG. 5.

It will be apparent that the invention is not limited to the embodiment described above. For example, as shown in FIGS. 5 and 6, the invention may be embodied in such an arrangement in which a reflection type photoelectric sensor 14 adapted to detect the reed dent 2*a* and another reflection type photoelectric sensor 15 adapted for detecting the warps $T_1$ are combined in an integral unit which is moved in the direction widthwise of the cloth, wherein the actual warp array pattern is searched or established by determining correspondences existing between the inter-dent gaps S detected by the photoelectric sensor 14 and the warps $T_1$ detected by the photoelectric sensor 15. A mounting body 16 for mounting the photoelectric sensors 14 and 15 has a bottom surface placed in contact with the warp $T_1$, wherein the photoelectric sensor 15 is positioned closely adjacent to the warps $T_1$. With this arrangement, there is no necessity to load the dent density information into the data memory $C_{21}$ of the textile weave/color information input control computer $C_2$.

Figure 7:
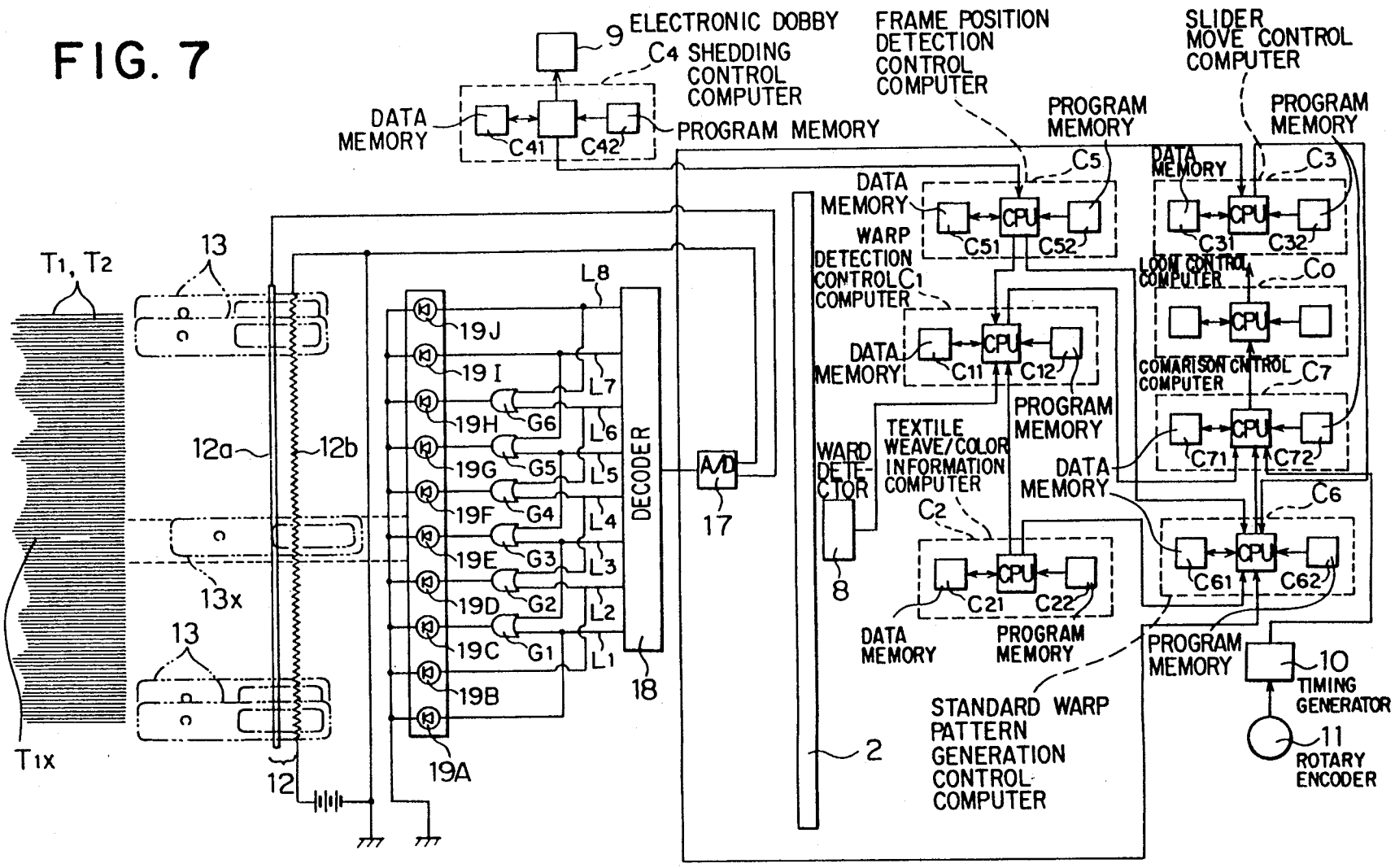
FIG. 7 is a circuit diagram showing a circuit arrangement for a warp insertion supervising apparatus according to a further embodiment of the present invention.

FIG. 7 shows still another embodiment of the present invention according to which the position of the movable warp detector 8 and the reference warp array pattern can be determined with the aid of a warp breakage detecting device in which a dropper $\mathbf{13}_x$ associated with the broken warp drops onto a contact bar 12 composed of a conductor 12*a* and a resistor 12*b*.

More specifically, referring to FIG. 7, an A/D converter 17 is connected to the contact bar 12 so that a voltage derived from the contact bar 12 and having a magnitude determined definitely by the position on the resistor 12*b* at which the dropper $\mathbf{13}_x$ drops thereon is converted into a corresponding binary digital signal by the A/D converter 17. The binary digital signal outputted from the A/D converter 17 is then input to a decoder 18 having a number of output pins or lines $L_i$ (where $i=1\sim8$ in the instant embodiment) which corresponds to the number of bits contained in the binary signal output of the A/D converter 17. In response to the binary digital signal, the decoder 18 outputs a high level signal at a particular one ($L_4$ in the illustrated embodiment) of the output lines $L_i$ which corresponds to the voltage derived from the contact bar 12. The high level signal output from the decoder 18 is applied to the inputs of a pair of OR gates ($G_2$ and $G_4$ in FIG. 7) of those $G_1$ to $G_6$, which ultimately results in that a pair of indication lamps (19D and 19F) of those 19A to 19J arrayed in a row are lit. Thus, the warp breakage position can readily be identified.

Further, the A/D converter 17 is also connected to the slider move computer $C_3$ and the standard warp pattern generation control computer $C_6$ so that the slider move control computer $C_3$ identifies the detection position by the warp detector 8 on the basis of the warp breakage position detecting information outputted from the A/D converter 17, while the standard warp pattern generation control computer $C_6$ arithmetically determines the warp array pattern group on the basis of the detected warp breakage position information outputted from the A/D converter 17 and the textile weave information.

Parenthetically, it should be noted that in the case of textile weaves for which the rows of the droppers 13 above the contact bar 12 and the heald frames 1 are in one-to-one corresponding relation with regard to the warp insertion or hooking, erroneous warp insertion or hooking can be detected without the need for checking all the shedding patterns. In other words, detection for the erroneous heald hooking (i.e. erroneous warp insertion) may be performed only for the heald frame which corresponds to the dropper row that contains the dropped dropper. In that case, the warp detection may be performed simultaneously with the reverse rotation of the warp feed apparatus and the cloth wind-up apparatus effected for the adjustment of the cloth fell.

According to further aspects of the invention, the warp detection may be performed at the rear side of the reed, i.e., the warp supply side, and/or a plurality of sets of warp detectors may be so disposed as to simultaneously perform the search operation for both the upper and lower warp arrays.

Additionally, the invention may be implemented so as to search for the warp insertion failure by detecting the number of warps inserted through one inter-dent gap.

As will be appreciated from the foregoing detailed description, according to the present invention, a warp detector having a warp presence/absence detecting region located in the vicinity of a reed at a front or rear side thereof is provided for a loom so that the presence or absence of an abnormality in the positions of the warps inserted through the reed can be detected on the basis of the detection information supplied from the warp detector at the time point when the loom is stopped. This enables any erroneous warp hooking or insertion to be discriminatively identified before the loom is restarted, with the resultant advantages that occurrence of defects due to the erroneous warp insertion as well as any degradation in the availability or operational efficiency of the loom due to the detection of the presence of an erroneous warp insertion can be positively avoided.

It is thought that the present invention will be understood fromt he foregoing description and it will be apparent that various changes may be made in the form, construction and arrangement thereof without departing from the spirit and scope of the invention or sacrificing all of its material advantages, the form hereinbefore described being merely preferred or exemplary embodiments thereof.

We claim:

1. A method of detecting insertion of warps in reed dents in a weaving mechine in which a weft inserted through a shedding formed by upward and downward motions of heald frames is beaten by a reed against a cloth fell of cloth being woven, said method comprising the steps of:

providing a movable warp detector having a region in which a presence/absence of the warps are to be detected;

stopping said weaving machine in response to warp breakage and thereafter inserting a warp through the reed;

thereafter moving said warp detector to a position that is close to the reed for obtaining detection information; and determining a presence or absence of an abnormality in the position at which said warps are inserted through the reed utilizing the detection information supplied by said warp detector.

2. A warp reed dent insertion monitoring apparatus for a weaving machine including heald frames, and a reed for beating a weft inserted through a shedding formed by upward and downward motions of said heald frames against a cloth fell of cloth being woven, said warp insertion monitoring apparatus comprising:

warp detector means positioned adjacent said reed so as to be movable along said reed for detecting a presence/absence of the warps;

means for detecting warp breakage;

means for stopping said weaving machine upon detecting said warp breakage;

means for moving said warp detector means to a particular region to be detected while said weaving machine is stopped; and means for determining after insertion of a warp through the reed the presence or absence of an abnormality in the positions at which warps are inserted through said reed utilizing detection information supplied by said warp detector means.

3. A warp reed dent insertion monitoring apparatus according to claim 2, wherein said warp detector means is disposed for movement adjacent the front side of said reed.

4. A warp reed dent insertion monitoring apparatus according to claim 2, wherein said warp detector means includes further means for simultaneously scanning arrays of upper and lower warps.

5. A warp reed dent insertion monitoring apparatus according to claim 2, wherein said warp detector means comprises: a first sensor for detecting dents of said reed; a second sensor for detecting warps existing in inter-dent gaps of said reed; and a mounting body for mounting thereon said first and second sensors; wherein said abnormality presence or absence detecting means is adapted to determine an actual warp array pattern on the basis of correspondence between said inter-dent gaps of said dents detected by said first sensor and said warps detected by said second sensor.

6. A warp reed dent insertion monitoring apparatus according to claim 5, wherein said first sensor comprises a reflection type photoelectric sensor.

7. A warp reed dent insertion monitoring apparatus according to claim 5, wherein said second sensor comprises a reflection type photoelectric sensor.

8. A warp reed dent insertion monitoring apparatus according to claim 5, wherein said mounting body has a lower convex surface for contacting the warps, while said second sensor is located on said mounting body for disposition closely adjacent said warps.

9. A warp reed dent insertion monitoring apparatus according to claim 2, wherein said warp detector means is disposed for movement adjacent the rear side of said reed.

10. A warp insertion monitoring apparatus for a weaving machine including heald frames, and a reed for beating a weft inserted through a shedding formed by upward and downward motions of said heald frames against a cloth fell of cloth being woven, said warp insertion monitoring apparatus comprising:

warp detector means movably disposed adjacent said reed, said warp detector means having a warp presence/absence detection region for obtaining warp array information;

means for moving said warp detector means to a particular region with respect to the direction widthwise of said cloth;

decision means for deciding the presence or absence of an abnormality in the positions at which said warps are inserted through said reed on the basis of a comparison of the standard warp array information associated with said particular region and said warp array information supplied from said warp detector means; and means for generating a timing signal and sending it to said decision means for timing the operation of said decision means.

11. A warp reed dent insertion monitoring apparatus according to claim 10, further including means for designating said particular region to which said warp detector means is to be moved.

12. A warp reed dent insertion monitoring apparatus according to claim 11, wherein said region designating means comprises a plurality of conductive droppers through which said warps are to be inserted in one to one correspondence, and a contact bar composed of an electrical conductor and a resistance element for receiving a dropper thereon, which drops upon occurrence of breakage of the corresponding warp.

13. A warp reed dent insertion monitoring apparatus according to claim 12, wherein said region designating means further comprises:

an analogue-to-digital (A/D) converter connected to said contact bar for converting into a corresponding binary digital signal an output voltage obtained from said contact bar as a function of the position on said resistance element at which said dropper drops thereon;

a decoder to which said binary digital signal is inputted, said decoder having a number of output lines corresponding to the number of bits contained in the bit pattern represented by said binary digital signal and outputting a level signal at a particular one of said output lines which corresponds to said output voltage;

a plurality of OR gates connected to said decoder; and a plurality of indicator lamps connected to said OR gates;

wherein said level signal is applied to the inputs of two of said OR gates for lighting a corresponding two of said indicator lamps to thereby indicate the position at which the breakage of the warp occurs.

14. A warp reed dent insertion monitoring apparatus according to claim 11, further comprising:

means for detecting upper and lower positions of said heald frames upon forming said shedding;

means for inputting textile weave information of said cloth;

means for generating said standard warp array information on the basis of the textile weave information supplied from said textile weave information input means and the frame position information supplied from said frame position detecting means; and decision means for deciding the presence or absence of an abnormality in the positions at which said warps are inserted through said reed on the basis of the results of a comparison of the warp array information associated with said particular region and supplied from said warp detector with said standard warp array information supplied from said standard generating means.

15. A warp reed dent insertion monitoring apparatus according to claim 14, wherein said frame position detecting means, said textile weave information input means, said standard generating means, said warp detector move control means and said decision means are constituted by computerized controllers, respectively.

16. A warp reed dent insertion monitoring apparatus according to claim 15, wherein said timing signal generating means comprises a rotary encoder for detecting the rotational angle of said weaving machine for thereby outputting a corresponding signal once for every revolution of said weaving machine, and a timing generator for generating said timing signal by shaping said signal supplied from said rotary encoder.

17. A warp reed dent insertion monitoring apparatus according to claim 15, further including an electronic Dobby apparatus for effectuating upward and downward motions of said heald frames, wherein said frame position detecting means further comprises a shedding control computing means for controlling actuation of said electronic Dobby apparatus and supplying the textile weave information to said standard generating means.

18. A warp reed dent insertion monitoring apparatus according to claim 15, wherein said textile weave information input means comprises a textile weave/color information input control computer to which color information is inputted in addition to the textile weave information.

19. A warp reed dent insertion monitoring apparatus according to claim 15, said region designating means being further connected to said move control computerized controller and said standard generation means computerized controller, wherein said move control controller specifies the detection position of said warp detector on the basis of the warp breakage position detecting information supplied from said region designating means, while said standard generation means controller arithmetically determines a set of warp array patterns on the basis of the detected warp breakage position information supplied from said region designating means and the textile weave information.

* * * * *

UNITED STATES PATENT AND TRADEMARK OFFICE

CERTIFICATE OF CORRECTION

PATENT NO. : 5,165,454

DATED : November 24, 1992

INVENTOR(S) : H. Kanayama

It is certified that error appears in the above-indentified patent and that said Letters Patent is hereby corrected as shown below:

Column 10, line 42, change "fromt he" to --from the--.

Column 11, line 56, after "warp" insert --reed dent--.

Signed and Sealed this

Eighth Day of February, 1994

Bruce Lehman

*Attest:*

BRUCE LEHMAN

*Attesting Officer*

*Commissioner of Patents and Trademarks*